United States Patent [19]

Rockenfeller et al.

[11] Patent Number: 4,727,693

[45] Date of Patent: Mar. 1, 1988

[54] APPARATUS FOR ANCHORING A TRACTION MEMBER IN THE GROUND

[75] Inventors: Gottfried Rockenfeller, Hilchenbach; Wolfgang Rockenfeller, Hilchenbach-Helberhausen, both of Fed. Rep. of Germany

[73] Assignee: Rockenfeller KG Befestigungselemente, Hilchenbach, Fed. Rep. of Germany

[21] Appl. No.: 879,808

[22] Filed: Jun. 27, 1986

[30] Foreign Application Priority Data

Jul. 1, 1985 [DE] Fed. Rep. of Germany ... 8519054[U]

[51] Int. Cl.[4] ..... E02D 5/74

[52] U.S. Cl. ..... 52/163; 52/166

[58] Field of Search ..... 52/153, 158, 166, 155–159, 52/162–164

[56] References Cited

U.S. PATENT DOCUMENTS

| | | | |
|---|---|---|---|
| 768,705 | 8/1904 | Swan | 52/163 |
| 972,306 | 10/1910 | Wilcox et al. | 52/153 |
| 1,564,069 | 12/1925 | Hoovens | 52/163 |
| 1,616,801 | 2/1927 | Hoovens | 52/163 |
| 1,821,125 | 9/1931 | Thom | 52/163 |
| 3,888,057 | 6/1975 | Zubke | 52/166 X |
| 4,574,539 | 3/1986 | Deike | 52/163 |

FOREIGN PATENT DOCUMENTS

| | | | |
|---|---|---|---|
| 0161190 | 5/1985 | European Pat. Off. | 52/163 |
| 2711979 | 11/1981 | Fed. Rep. of Germany | 52/153 |
| 7928810 | 6/1981 | France | 52/163 |
| 2470823 | 6/1981 | France | 52/163 |
| 2089862A | 6/1982 | United Kingdom | 52/163 |
| 2133057A | 7/1984 | United Kingdom | 52/163 |

*Primary Examiner*—Alfred C. Perham

*Attorney, Agent, or Firm*—Karl F. Ross; Herbert Dubno

[57] ABSTRACT

The apparatus for anchoring a traction member comprises an anchoring body which is a molded piece with a transverse cross section small compared to its longitudinal cross section and an insertable guiding rod couplable detachably with the anchoring body and alignable longitudinally with the anchoring body. An attaching piece for the traction member is mounted laterally on the anchoring body with spacing from both ends of it. To provide an easier removal of an anchoring apparatus erroneously inserted in the ground the anchoring body is provided with a cutter like tapered front end and simultaneously on a rear end a sectioning for nonrotatable engagement with the insertable guiding rod. The attaching piece for the traction member is mounted between the center of gravity of the anchoring body and the cutter like tapered front end and comprises a shackle, a ring loop or a chain link engaged pivotally in a passage through the anchoring body.

19 Claims, 17 Drawing Figures

Fig. 7
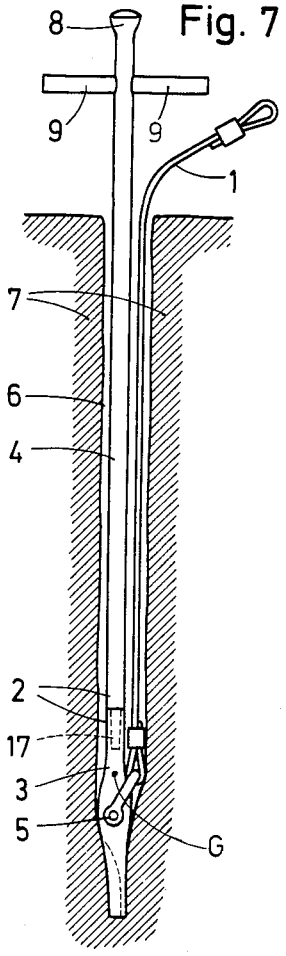
Fig. 9
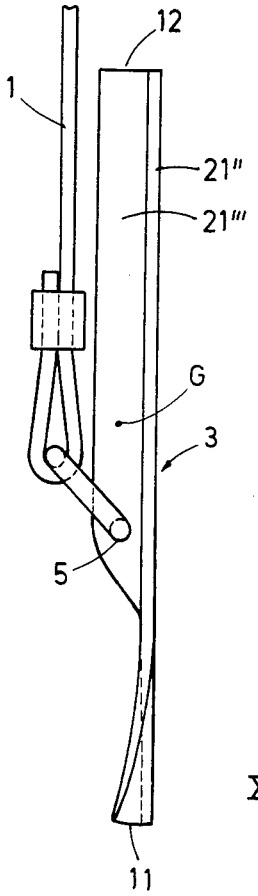
Fig. 10
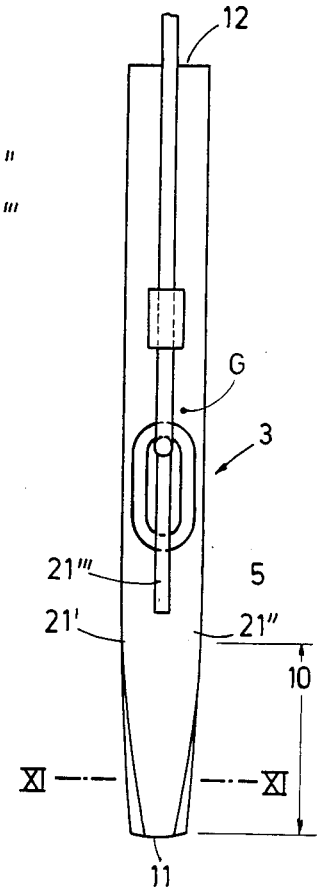
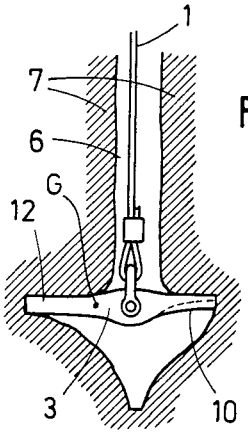
Fig. 8
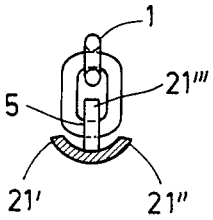
Fig. 11

Fig. 12
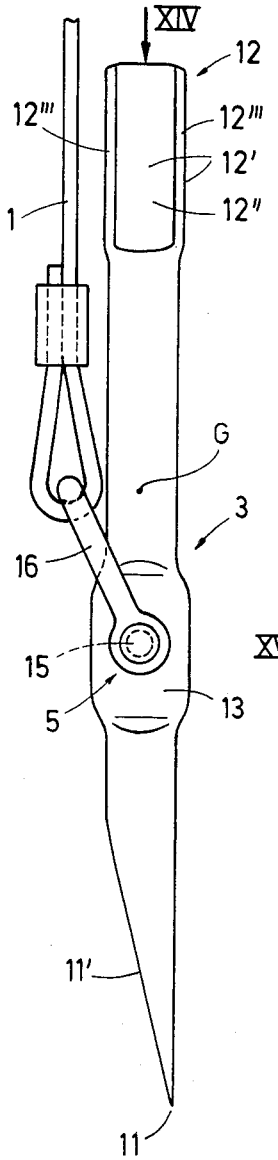
Fig. 13
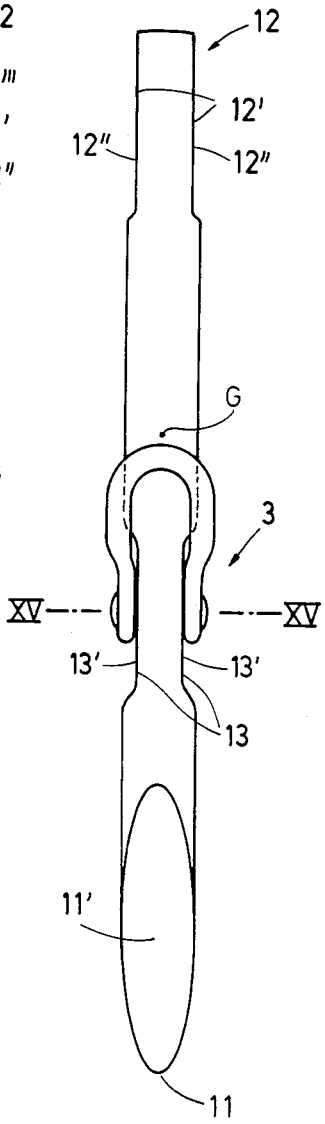
Fig. 16
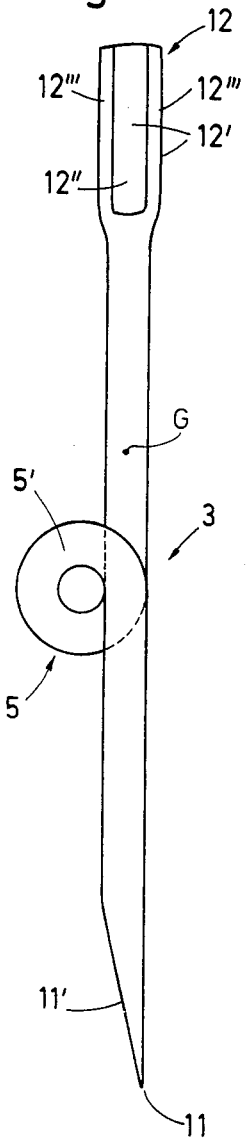
Fig. 14
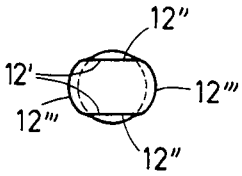
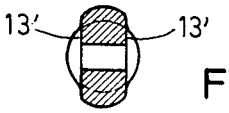
Fig. 15

APPARATUS FOR ANCHORING A TRACTION MEMBER IN THE GROUND

FIELD OF THE INVENTION

The present invention relates to a ground anchor for a pulling or traction member such as a cable, rope, chain or the like, i.e. to a deadboy for such an anchor.

BACKGROUND OF THE INVENTION

A known apparatus for anchoring a pulling member comprises an anchoring body formed as a molded piece with a transverse cross section small compared to its longitudinal cross section and an insertable guiding rod couplable detachably with it and alignable longitudinally with the anchoring body. The attaching piece for the pulling member is mounted laterally on the anchoring body with spacing from both ends of it (see U.S. Pat. No. 972,306 and German Pat. No. 27 11 979).

In one known ground or earth anchor an insertable anchoring body is used which has a rear end bent so that it is inclined with respect to the longitudinal axis of the anchoring body. On the side of the anchoring body opposite outwardly bent portion of its rear end between its center of gravity and that rear end, an attaching piece is provided for the pulling member.

According to U.S. Pat. No. 972,306 the anchoring body is a substantially flat steel plate with arrow shaped ends and a mounting shoe for the connecting or guiding rod is attached to one flat side of the steel plate by welding or riveting. Furthermore the mounting shoe has an eye for attachment of a pulling member. According to German Pat. No. 27 11 979 the anchoring body is made from a pipe section having a recess which is suitable for receiving the connecting or guiding rod and at its inside front end has a constricted section which is a bearing shoulder for the connecting or guiding rod.

The ground of German Pat. No. 27 11 979 has, in contrast to that of U.S. Pat. No. 972,306, an advantage, namely that it may be manufactured easily in one piece from a pipe section which need be provided with no additional elements of structures, since the attaching piece for the pulling member can be a handle or hook like piece of the pipe section cut out or pressed out of the pipe section.

Both above mentioned known ground or earth anchors have the disadvantage however that for automatic pivoting into their anchoring position with a force acting on the pulling member they must be cut not only at their rear end inclined to their longitudinal axes and must be provided with a lip shaped bent out section, but also simultaneously the attaching piece for the pulling member must be mounted so that it is found on the side opposing the bent out section of the rear end and between the center of gravity and the rear end.

Practical experience has shown that after erroneous insertion in unbroken ground or filled earth, these known earth or ground anchors cannot be removed but are lost unless dug out of the ground in a troublesome and time consuming way.

The desired withdrawal from the ground after erroneous insertion through the shaft in the earth formed by the anchor is prevented by the particular shape of its rear end cut inclined to its longitudinal axis and lip shaped bent outwards, a rearwardly directed force exerted by the pulling means invariably digs the anchor into the surrounding earth and as a consequence slants it in an undesirable way in the direction of its anchoring position even when it is still engaged with the connecting or guiding rod used to drive it into the ground.

These known earth or ground anchors can not be driven into stoney ground without problems. In case of the earth or ground anchor according to U.S. Pat. No. 972,306 the front point of the steel plate of the anchoring body is bent away laterally comparatively easily on encountering a flat thick stone and thus is prevented from further penetration to sufficient depth in the ground. Also the ground and/or earth anchor according to German Pat. No. 27 11 979 on account of its comparatively large circular front surface can not pass stones in its path and can be prevented from penetrating to a sufficient depth in the ground.

OBJECTS OF THE INVENTION

It is an object of the invention to provide an improved apparatus, such as a deadboy or ground anchor, for anchoring a pulling or traction member in the ground.

It is a further object of the invention to provide an improved apparatus for anchoring a pulling member, such as a rope, line, chain or the like, in unbroken or disturbed ground, and which in the case of an erroneous insertion may be drawn out of the shaft and reused without problems.

It is another object of the invention to provide an improved apparatus for easily anchoring to a sufficient depth a pulling member such as a cable, wire, chain or the like in unbroken or disturbed earth having stoney layers.

SUMMARY OF THE INVENTION

These objects and others which will become more apparent hereinafter are attained in accordance with the invention in an apparatus for anchoring a traction member comprising an anchoring body which is a molded or shaped piece with a transverse cross section small compared to its longitudinal cross section and an insertable guiding rod couplable detachably with the anchoring body and alignable longitudinally with the anchoring body. The attaching piece for the pulling member is mounted laterally on the anchoring body with spacing from both ends of the anchoring body.

According to the invention the anchoring body is provided with a cutter like tapered front end and simultaneously on a rear end with a sectioning for nonrotatable engagement with the insertable guiding rod, and the attaching piece for the pulling member is mounted between the center of gravity of the anchoring body and the cutter like tapered front end and comprises a shackle, a ring loop or a chain link engaged pivotally in a passage through the anchoring body.

By using the invention the insertion of the anchoring body to the desired depth in stoney ground is made easier and it is also guaranteed that an anchoring body which is erroneously or incorrectly put in place may be drawn out from the shaft using the insertable guiding rod and can then be reused. The knife like tapered front end of the anchoring body not only makes insertion into normal ground easy but also contributes to the break up of stone layers found near the shaft in the ground for the anchoring body. The breaking up of such stone layers is then facilitated since the anchoring body is allowed to pivot or rotate about its axis during the anchor-drawing process with the help of the insertable guiding rod not only about its longitudinal axis but simultaneously also can be pivoted away from stones acting as hindrances.

Advantageously the front end of the anchoring body has an approximately semicircular grooved shaped transverse cross section. Since the knifelike tapered front end of the anchoring body maintains a highly stable shape, the anchoring body acts by rotation about its longitudinal axis like a drill and thus either is forced through stones projecting into the shaft or is swung away from them and guided past them.

The anchoring body has a stable shape when the transverse cross section is reduced in a direction along the anchoring body toward the attaching piece and disappears at the periphery of the anchoring body adjacent the attaching piece.

Advantageously the anchoring body is provided adjacent the attaching piece of the pulling member with a peripheral bulge lying substantially in the plane of symmetry of the groove shaped transverse cross section whose smallest transverse cross sectional dimension is directed along the longitudinal axis of the passage. The largest cross sectional dimension extends in the direction of the peripheral bulge lying in the plane of symmetry of the grooved shaped cross section of the anchoring body.

As a result the cross sectional dimension of the anchoring body is not substantially greater near the attaching piece of the pulling member than at any place along its length so that insertion into the ground is facilitated.

Both the insertion of and also the drawing out of an erroneously placed ground or earth anchor is particularly easy when the sectioning for the nonrotatable engagement of the insertable guiding rod in the rear end of the anchoring body has a transverse cross sectional dimension which exceeds the greatest transverse cross sectional dimension of the bulk of the anchoring body.

The anchoring body may have an elongated or oval transverse cross section both in the vicinity of the attaching piece of the pulling member and also at the rear end thereof and the planes of the greatest cross sectional dimensions of the anchoring body are approximately oriented at right angles to each other.

The sectioning for the nonrotatable engagement of the insertable guiding rod advantageously comprises an axial recess in the rear end of the anchoring body, which is associated with a corresponding sectioning engaging pin at the front end of the insertable guiding rod.

The sectioning for the nonrotatable engagement of the insertable guiding rod at the rear end of the anchoring body can also alternatively comprise an axial pin which is associated with a suitably shaped recess at the front end of the insertable guiding rod. The attaching piece of the pulling member may be mounted on the anchoring body near a position which is provided about a third of the total length from the front end.

The shackle, the ring loop or the chain link can be associated at its free ends with the sides of the anchoring body corresponding to the rear side of the groove shaped cross section of the anchoring body or alternatively the shackle, the ring loop or the chain link can be associated with its free ends with the sides of the anchoring body corresponding to the front side of the groove shaped cross section.

The shackle can be attached detachably with the anchoring body by a detachable threaded bolt. The anchoring body may be pressed or forged from a heavy material, for example steel. Particularly the anchoring body may be constructed from a pressed flank of solid or tubular material.

The grooved cross section has a large wall thickness at the front end of the anchoring body, this thickness being in a ratio to the largest groove width of about 0.25:1 and to the largest groove height of about 0.38:1.

The insertable guiding rod can be provided with a head like enlargement under which two radially directed handles projecting in opposite directions from the insertable guiding rod are provided for holding, guiding and rotating the insertable guiding rod.

The anchoring body is formed from a T-shaped or also +shaped section, in which two parallel sides are formed in a groove like shape in the vicinity of the front end of the anchoring body, while there the sides or side is or are cut away up to the attaching piece for the pulling member.

The anchoring body can be made of heavy round stock, can have at its front end a steep chamfering over its entire cross section which forms a knife edge, and can have its sectioning formed by an indentation on both sides of the anchoring body at the rear end. The sectioning at the rear end of the anchoring body advantageously is oriented on the plane of symmetry of the cutting or knife edge and the surface indentations and a similar surface impression in the vicinity of the attaching piece of the tension providing member are positioned parallel to each other. The anchoring body can also comprise a wire piece with a large transverse cross section on which the attaching piece for the pulling member is a wound loop in the wire piece.

BRIEF DESCRIPTION OF THE DRAWING

The above and other objects, features and advantages of the invention will become more readily apparent from the following specific description, reference being made to the accompanying drawing in which:

FIG. 7 is a cross sectional view of the entire assembly comprising the apparatus for anchoring a pulling member in the ground at the end of the insertion process;

FIG. 8 is a cross sectional view of the apparatus of FIG. 7 with the anchoring body positioned transversely to the lower end of the insertion duct in its operating position;

FIG. 9 is a side elevational view of the anchoring body in an alternative embodiment of the apparatus for anchoring of a pulling member according to the invention;

FIG. 10 is a rear elevational view of the apparatus shown in FIG. 9;

FIG. 11 is a bottom partially cross sectional view of the apparatus of FIG. 9 taken along the section line XI—XI;

FIG. 12 is a side elevational view of another embodiment of the apparatus for anchoring a pulling member in the ground according to the invention;

FIG. 13 is a rear elevational view of the apparatus shown in FIG. 12;

FIG. 14 is a top view of the apparatus of FIG. 12 as seen in the direction of the arrow XIV of FIG. 12;

FIG. 15 is a cross sectional view of the apparatus of FIG. 12 taken along the section line XV—XV in FIG. 13;

FIG. 16 is a side elevational view of yet another embodiment of the invention.

SPECIFIC DESCRIPTION

Figure 1:
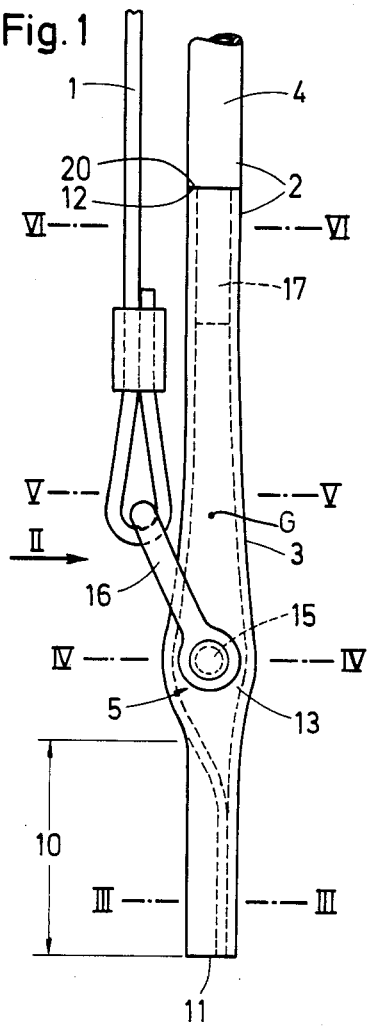
FIG. 1 is a side elevational view of an inserting and guiding rod with an engaged anchoring body at its lower end which is a principal part of an apparatus for anchoring a pulling member according to the invention shown in its natural size.

In many cases it is necessary to anchor a traction member 1, for example a cable, rope, line, chain or the like, in unbroken earth or in loosened earth or fill with the smallest possible expenditure of energy but securely enough to anchor it properly.

In order to make that possible a special anchoring device 2 is required which comprises an anchoring body 3 formed as a molded part with a small transverse cross section compared to its length or longitudinal cross section and an insertable guiding rod 4 couplable detachably with it and alignable longitudinally with this anchoring body 3 as seen in FIG. 7. The attaching piece 5 for the traction member 1, for example a plastic coated steel line, a chain or the like, is mounted laterally on the anchoring body 2 with clearance from both of its ends.

As can be seen from FIG. 7 the anchoring body 3 may be inserted in the unbroken earth by driving it through the ground, simultaneously forming a shaft 6 with the aid of the insertable guiding rod 4. For this purpose a few forceful hammer blows are applied to the upper end of the insertable guiding rod 4 provided with an enlarged head 8. Two radial handles 9 on opposite sides of the guiding and inserting rod 4 are used for holding, guiding and rotating, below the enlarged head 8, the insertable guiding rod 4 and with it also the anchoring body 3 during the insertion process. The rod 4 not only can be rotated about its longitudinal axis but it is also possible to influence the insertion direction of the anchoring body 3 in the ground 7.

Simultaneously on insertion of the anchoring body 3 into the ground 7 the traction member 1 is pulled to an insertion depth corresponding with the shaft 6 because it is attached to the anchoring body 3.

Figure 2:
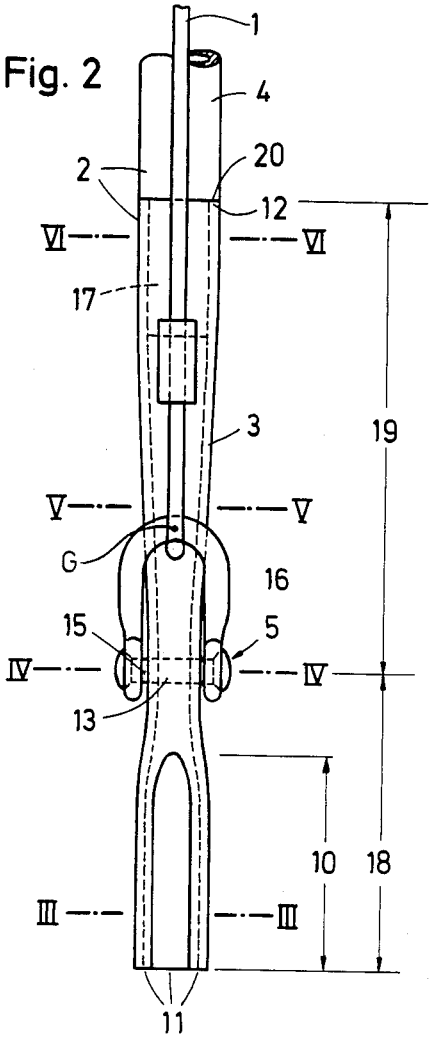
FIG. 2 is a rear elevational view of the anchoring body and guiding rod shown in FIG. 1 as seen in the direction of the arrow II of FIG. 1.
Figure 3:
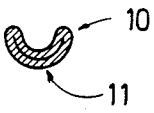
FIG. 3 is a cross sectional view of the apparatus of FIG. 1 taken along the section line III—III of FIGS. 1 and 2.
Figure 4:
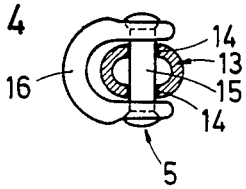
FIG. 4 is a cross sectional view of the apparatus of FIG. 1 taken along the section line IV—IV of FIGS. 1 and 2.
Figure 5:
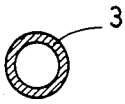
FIG. 5 is a cross sectional view of the apparatus of FIG. 1 taken along the section line V—V of FIGS. 1 and 2.
Figure 6:
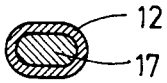
FIG. 6 is a cross sectional view of the apparatus of FIG. 1 taken the section line VI—VI of FIGS. 1 and 2.

From FIGS. 1 to 3 it is apparent that the anchoring body 3 comprises a molded piece which either is made from a massive piece of bar material or from a piece of piping like a pressure mold. The front end 10 of the anchoring body 3 is formed with a substantially partially rounded groove shaped cross section, which is tapered at its lower end to a front cutting edge 11, while it simultaneously on its rear end 12 changes from a circular cross section to for example a longitudinal or oval cross section as is apparent from FIG. 6.

From FIGS. 1 and 2 the groove like cross section on the front end 10 of the anchoring body 3 is reduced in the direction of the attaching piece 5 for the traction member 1 and disappears at the periphery of the anchoring body 3 near the attaching piece 5.

Also in the vicinity of the attaching piece 5 for the traction member 1 the anchoring body 3 is provided with a peripheral bulge 13 lying in the symmetry plane of the groove shaped cross section whose smallest cross sectional dimension is along the longitudinal axis of the transverse hole 14 which receives a bolt 15 which for example can carry a shackle 16 to which the traction member 1 is attached.

Instead of the shackle 16 attached by the bolt 15 to the anchoring body 3, a ring loop or a chain link can be used which instead of the bolt 15 engages directly the transverse hole 14 in the vicinity of the peripheral bulge 13.

From FIGS. 1, 2, 4 and 6 it is seen that the largest transverse cross sectional dimension of the peripheral bulge 13 extends in the direction of the plane of symmetry of the groove shaped cross section at the front end 10 of the anchoring body 3, while the largest transverse cross sectional dimension of the anchoring body 3 is at the upper end of the anchoring body 3 at right angles to it and also extends parallel to the longitudinal axis of the transverse hole 14 in the anchoring body 3.

The elongated, rounded or oval cross section at the rear end 12 of the anchoring body 3 acts to detachably but nonrotatably engage a pin 17 fitting into it mounted at the front end of the insertable guiding rod 4 formed so that a rotation of the insertable guiding rod 4 also causes a suitable collateral rotation of the anchoring body 3 inside of the shaft 6.

The engagement of the pin 17 in the end 12 of the anchoring body 3 is secured in position sufficiently stably so that an inclination of the insertable guiding rod 4 in the shaft 6 causes a suitable inclination of the anchoring body 3 during the insertion process. Hence the anchoring body 3 can be driven into the ground according to need and may pass stones found in the vicinity of the shaft 6 in as much as these can not be broken up by the cutting edge 11 at the front end 10.

An important structural criteria of the anchoring body 3 is that the attaching piece 5 for the traction member 1, also the transverse hole 14 for receiving the bolt 15 and/or a ring loop or a chain link has a spacing 18 from the cutting edge 11 of the front end 10 which corresponds to a third of the total length of the anchoring body 3 and thus a spacing 19 from the rear end 12 of the anchoring body which is about two thirds of the entire length. With these dimensions the attaching piece 5 for the traction member 1 on the anchoring body 3 acts between the center of gravity G and the cutting edge 11 formed on the front end 10.

It is also important that the cross section of the nonrotatable fitting pin 17 of the insertable guiding rod 4 has a cross sectional measurement which is less than the largest cross sectional measurement of the anchoring body 3. Also the part of the guiding rod 4 immediately connected to the pin or bolt 17 should have a cross section which nowhere exceeds the largest cross section of the anchoring body 3. The shoulder 20 of the insertable guiding rod 4 ends on the periphery of the rear end 12 of the anchoring body 3 so that an unobjectionable cooperation of the insertable guiding rod 4 with the anchoring body 3 is guaranteed at all times.

During the insertion process the upper end 12 of the anchoring body 3 can not anchor into the ground surrounding the shaft 6, as long as the insertable guiding rod 4 is in engagement with it and the guiding rod 4 takes control in the shaft 6. It is of course easily possible to raise again an anchoring body 3 inserted into the ground 7 erroneously together with the insertable guiding rod 4 simply by traction on the traction member 1. Without complicated measures the anchoring body 3 removed from the ground can be used again.

As soon as the anchoring body 3 has been duly inserted the insertable guiding rod 4 is drawn out from the upper end 12. On pulling on the traction member 1 the anchoring body 3 then adjusts itself so that it is inclined by action of its center of gravity G found above the attachment position. The anchoring body 3 is then forced with its upper end 12 with simultaneous pivoting about the attaching piece 5 transversely into the surrounding ground 7, while also the front end 10 swinging to the opposing side and laterally upwards is forced into the surrounding earth. In FIG. 8 the anchoring body 3 is shown in its final position and holds the traction member 1 fixed in the ground.

Figure 17:
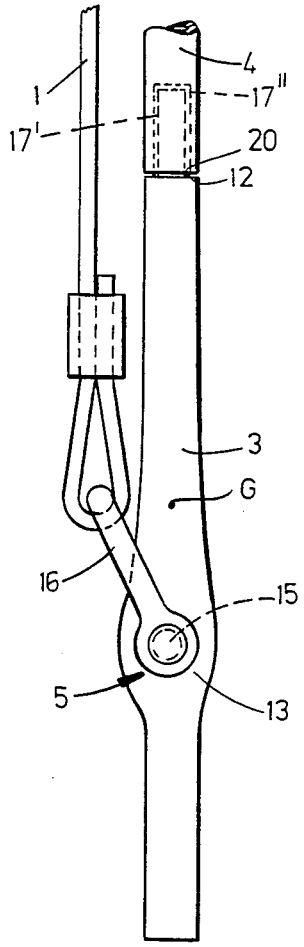
FIG. 17 is a side elevational view of another embodiment of the apparatus for anchoring a pulling member.

The cooperation of the anchoring body 3 with the insertable guiding rod 4 can operate in a reverse way, so that the pin 17' may project from the upper end 12 of the anchoring body 3 and a hole 17" fitting it is provided in the lower end of the insertable guiding rod 4 (FIG. 17).

Various embodiments featuring different anchoring bodies 3 are possible. It is possible to hold the shackle 16 with a detachable screwable axial bolt 15 in the transverse passage 14. It could also be possible to change the shackle from the positions shown in FIGS. 1, 2 and 4 so that the force of the traction member 1 can operate on the opposing side of the anchoring body 3.

In one tested structure of the anchoring body 3 the groove like cross section of the front end 10 of the anchoring body 3 has a large wall thickness whose ratio to the largest groove width is 0.25:1 and to the largest groove height approximately 0.38:1.

In FIGS. 9 to 11 an embodiment of the apparatus of the invention which differs from that shown in FIGS. 1 to 3 is shown. This anchoring body 3 is thus made from an approximately T-shaped profile or section, for example a rolled section in which two parallel sides 21' and 21" are curved in the vicinity of the front end 10 to form a groove shaped cross section, while there the sides turned transversely are cut away until up to the attaching piece 5 for the traction member 1. Thus the groove shaped cross section with its cutting edge 11 can easily be forced into the unbroken ground.

The insertable guiding rod 4 for the anchoring body 3 according to FIGS. 9 to 11 is slotted at its lower end corresponding to the position of the sides 21', 21" and 21''' in order to provide a nonrotatable engagement with the fitting anchoring body 3.

Moreover the operation of the anchoring body 3 according to FIGS. 9 to 11 is the same as in the case of FIGS. 1 to 8.

The anchoring body 3 according to FIGS. 12 to 15 is a variant of the example shown in FIGS. 1 to 6.

The anchoring body 3 in this embodiment is made from a heavy round bar member on which there is a steep chamfered section 11' running over the entire transverse cross section which is formed by a suitably cut section so that the cutting edge 11 is formed at its free end with an oval boundary line. So then the round bar member is subjected to a pressing process in order to form the sectioning 12' at the rear or upper end 12 of the anchoring body 3 for the nonrotatable engagement of the insertable guiding rod 4. This sectioning 12' is positioned on the plane of symmetry of the cutting edge 11 and comprises two parallel surfaces 12" which forms a constriction in the cross section of the round bar member as well as two bulged pieces 12''' which project beyond the round bar member's average transverse cross section.

In the same pressing process a peripheral enlargement 13 in the vicinity of the attaching piece 5 for the traction member is made. It comprises two surfaces 13' of the constricted round material which are parallel to each other and to the surfaces 12".

In this form of the anchoring body 3 it is clear that the guiding rod 4 must have a recess instead of a pin 17 which can engage the sectioning 12' on the upper end 12 of the anchoring body 3.

The anchoring body 3 according to FIG. 16 is formed from a heavy round wire section. The front end having the cutting edge 11 as well as the rear end 12 carrying the sectioning 12' have the same structure as that according to FIGS. 12 to 15. The attachment piece 5 for the traction member 1 is here however provided simply by wire wound in a loop 5'. The traction member 1 is necessarily attached to this.

By definition the front end of the anchoring body is that end which is first to be inserted in the ground or that end which is directed downwardly on insertion.

An additional embodiment is shown in FIG. 17 in which instead of a recess the rear end 12 of the anchoring body 3 has an upwardly directed pin 17' which engages in a corresponding recess 17" in the insertable guiding rod 4.

What is claimed is:

1. In an apparatus for anchoring a traction member comprising an elongated anchoring body which is shaped with a plurality of transverse cross sections each of which is small compared to the longitudinal cross section of said body and an insertable guiding rod couplable detachably with said anchoring body and alignable longitudinally with said anchoring body, wherein an attaching piece for said traction member is mounted laterally on said anchoring body with spacing from both ends of said anchoring body, the improvement wherein said anchoring body is provided with a cutter like tapered front end and simultaneously on a rear end with a sectioning for nonrotatable engagement with said insertable guiding rod, said sectioning being shaped to be flush with said rod upon the insertion thereon of said anchoring body, and said attaching piece for said traction member is mounted between the center of gravity of said anchoring body and said cutter like tapered front end and said attaching piece comprises a shackle engaged pivotally in a passage through said anchoring body, said front end of said anchoring body having an aproximately semicircular grooved shaped one of said transverse cross sections, said transverse cross section being reduced in a direction along said anchoring body toward said attaching piece, said anchoring body being provided adjacent said attaching piece of said traction member with a peripheral bulge lying substantially in the plane of symmetry of said groove shaped transverse cross section whose smallest transverse cross sectional dimension is directed along the longitudinal axis of said passage, while the largest cross sectional dimension of said peripheral bulge extends in said plane of symmetry of said grooved shaped cross section of said anchoring body.

2. The improvement according to claim 1 wherein said anchoring body has an elongated or oval one of said transverse cross sections both in the vicinity of said attaching piece of said traction member and also at said rear end thereof and the planes of said largest transverse cross sectional dimensions of said anchoring body are approximately oriented at right angles to each other.

3. The improvement according to claim 2 wherein said sectioning for said nonrotatable engagement of said insertable guiding rod at said rear end of said anchoring body comprises an axial pin which is associated with a suitably shaped recess at said front end of said insertable guiding rod.

4. The improvement according to claim 2 wherein said sectioning for said nonrotatable engagement of said insertable guiding rod comprises an axial recess in said rear end of said anchoring body, which is associated with a corresponding sectioning engaging pin at said front end of said insertable guiding rod.

5. The improvement according to claim 4 wherein said attaching piece of said traction member is mounted on said anchoring body near a position which is provided at a distance of about a third of the total length from said front end of said anchoring body.

6. The improvement according to claim 5 wherein said shackle, said ring loop or said chain link is associated with the free ends thereof with the sides of said anchoring body corresponding to the rear side of said groove shaped cross section of said anchoring body.

7. The improvement according to claim 5 wherein said shackle is associated with the free ends thereof with the sides of said anchoring body corresponding to the front side of said groove shaped cross section.

8. The improvement according to claim 7 wherein said shackle is attached detachably with said anchoring body by a detachable screwable axial bolt.

9. The improvement according to claim 8 wherein said anchoring body is formed by press blank from solid or tubular material.

10. The improvement according to claim 9 wherein said grooved transverse cross section has a wall thickness at said front end of said anchoring body which has a ratio to the largest groove width of about 0.25:1 and to the largest groove height of about 0.38:1.

11. The improvement according to claim 1 wherein said insertable guiding rod is provided with a head like enlargement under which two radially directed handles projecting in opposite directions from said insertable guiding rod are provided for holding, guiding and rotating said insertable guiding rod.

12. The improvement according to claim 1 wherein said anchoring body is formed from a T-shaped or also +shaped section, in which two parallel sides are formed in a groove like shape in the vicinity of said front end of said anchoring body, while their said sides or side is or are cut away up to said attaching piece for said traction member.

13. The improvement according to claim 1 wherein said anchoring body is made of heavy round stock, has at said front end a steep chamfering over said transverse cross section which forms a knife edge and said sectioning is formed by a surface indentation on both sides of said anchoring body at said rear end of said anchoring body.

14. The improvement according to claim 13 wherein said sectioning at said rear end of said anchoring body is oriented on the plane of symmetry of said cutting edge, wherein said surface indentations and a similar flat impression in the vicinity of said attaching piece of said traction member are positioned parallel to each other.

15. In an apparatus for anchoring a traction member comprising an elongated anchoring body which is shaped with a plurality of transverse cross sections each of which is small compared to the longitudinal cross section of said body and an insertable guiding rod couplable detachably with said anchoring body and alignable longitudinally with said anchoring body, wherein an attaching piece for said traction member is mounted laterally on said anchoring body with spacing from both ends of said anchoring body, the improvement wherein said anchoring body is provided with a cutter like tapered front end and simultaneously on a rear end with a sectioning for nontrotatable engagement with said insertable guiding rod, said sectioning being shaped to be flush with said rod upon the insertion thereon of said anchoring body, and said attaching piece for said traction member is mounted between the center of gravity of said anchoring body and said cutter like tapered front end and said attaching piece comprises a shackle engaged pivotally in a passage through said anchoring body, said anchoring body comprises a wire piece with a large one of said transverse cross sections to which said attaching piece for said traction member is a loop bent in said wire piece.

16. An apparatus for anchoring a traction member in the ground, comprising:

an elongated one-piece anchor body having a center of gravity located at an intermediate point between opposite ends thereof, one of said ends having a noncircular cross section, the other of said ends being generally cutter shaped and tapered away from said center of gravity for penetration into the ground with symmetry with respect to a plane of a longitudinal axis of said other end, said anchor body being provided with a protuberant portion spaced from said center of gravity and between said center of gravity and said other end broadened parallel to said plane and transversely to said axis, said protuberant portion being provided with a hole transverse to said axis;

means traversing said hole for articulatedly connecting a traction member to said protuberant portion; and a guide rod having a lower end of a shape complementary to said noncircular cross section of said one of said ends and detachably insertable thereof in a nonrotatable manner so that said lower end of said guide rod is substantially flush with said one end of said anchor body, whereby said guide rod can be used to insert said anchor body in the ground for anchoring therein by tension on said traction member and can be used to guide said anchor body out of the ground in the event of misplacement of said anchor body.

17. The apparatus defined in claim 16 wherein said anchor body is a tube having a semicircular bent cross section at said other end, a flattened oval cross section at said protuberant portion, a circular cross section between said protuberant portion and said one of said ends, and an oval cross section at said one of said ends forming said noncircular cross section, said means traversing said hole for connecting said traction member to said protuberant portion including a shackle straddling said portuberant portion and a bolt interconnecting legs of said shackle and traversing said hole, said plane being a longitudinal plane of symmetry of the entire anchor body.

18. The apparatus defined in claim 16 wherein said anchor body is a shaped solid body of circular cross section between said protuberant portion and said senter of gravity, a chamfer forming the cutter shape of said other of said ends, a bulge formed in said body with flat sides to constitute said protuberant portion, and a pair of flats formed in said body at said other end to constitute said noncircular cross section, said plane being a longitudinal plane of symmetry of the entire body, said means traversing said hole for connecting said traction member to said protuberant portion including a shackle straddling said protuberant portion and a bolt connecting legs of said shackle and extending through said hole.

19. The apparatus defined in claim 16 wherein said anchor body consists of a wire element provided with a chamfer at said other of said ends forming the cutter shape thereof, and a pair of flats at said one of said ends forming said noncircular cross section, said protuberant portion being a loop bent from the wire of said body.

* * * * *